US006539744B1

(12) United States Patent
Piao et al.

(10) Patent No.: US 6,539,744 B1
(45) Date of Patent: Apr. 1, 2003

(54) AIR-CONDITIONING APPARATUS

(75) Inventors: Chun-cheng Piao, Osaka (JP); Manabu Yoshimi, Osaka (JP); Ryuichi Sakamoto, Osaka (JP); Kazuo Yonemoto, Osaka (JP); Shotaro Mishina, Osaka (JP); Akira Kamino, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/857,486

(22) PCT Filed: Dec. 9, 1999

(86) PCT No.: PCT/JP99/06933

§ 371 (c)(1),
(2), (4) Date: Jun. 6, 2001

(87) PCT Pub. No.: WO00/36345

PCT Pub. Date: Jun. 22, 2000

(30) Foreign Application Priority Data

Dec. 16, 1998 (JP) ..... 10-357370

(51) Int. Cl.[7] ..... F25D 9/00
(52) U.S. Cl. ..... 62/402; 62/87
(58) Field of Search ..... 62/86, 87, 402

(56) References Cited

U.S. PATENT DOCUMENTS 4,207,754 A * 6/1980 Chaboseau et al. ..... 62/402
4,265,397 A * 5/1981 Rannenburg et al. ..... 62/402
4,334,411 A * 6/1982 Payne ..... 62/86
4,539,816 A * 9/1985 Fox ..... 62/87
5,323,624 A 6/1994 Schwalm ..... 62/401

FOREIGN PATENT DOCUMENTS

| | | |
|---|---|---|
| JP | 62-102061 | 5/1987 |
| JP | 62-223573 | 10/1987 |
| JP | 6-213521 | 8/1994 |
| JP | 8-318731 | 12/1996 |

* cited by examiner

*Primary Examiner*—Ronald Capossela
(74) *Attorney, Agent, or Firm*—Nixon Peabody LLP; Donald R. Studebaker

(57) ABSTRACT

A cycle-side system (20) is formed by duct connecting a compressor (21), a heat exchanger (30), a demoisturizer (22), and an expansion device (23) in that order. The compressor (21) draws in room air and supply air for ventilation and compresses the same. The compressed air exchanges heat with exhaust air for ventilation in the heat exchanger (30), thereby being cooled. Water vapor in the cooled, compressed air is removed in the demoisturizer (22). The demoisturizer (22) is provided with a separation membrane and separates water vapor in the compressed air without the occurrence of condensation. Thereafter, the compressed air is expanded in the expansion device (23) to change into low-temperature air. The low-temperature air is supplied into a room. On the other hand, the heat exchanger (30) is fed exhaust air cooled in a humidifying cooler (41). Further, in the heat exchanger (30), a latent heat of vaporization of moisture supplied by a humidifying part (42) is also utilized for cooling of the compressed air.

16 Claims, 3 Drawing Sheets

AIR-CONDITIONING APPARATUS

TECHNICAL FIELD

The present invention relates to an air cycle air-conditioning apparatus employing air as a refrigerant and, more particularly, to an efficiency improving scheme.

BACKGROUND ART

Cooling apparatus of the air cycle type in which air serves as a refrigerant have been conventionally known in the art. For example, there is disclosed in Japanese Unexamined Patent Gazette No. S62-102061 one type of air cycle cooling apparatus. This type of cooling apparatus includes a compressor, a heat exchanger, and an expansion device. That is, air is drawn into the compressor where the air is compressed. The compressed air is cooled in the heat exchanger and thereafter expanded in the expansion device, for obtaining low-temperature air of low temperature. In the cooling apparatus of the aforesaid Patent Gazette, the cooling air thus obtained is used for achieving cooling of the inside of a room. Further, in the cooling apparatus, the low-temperature air expanded in the expansion device is sprayed with water so that the -temperature of the low-temperature air is lowered to a further extent by evaporation of the water for enhancing cooling capacity.

PROBLEMS TO BE SOLVED

However, in the aforesaid conventional cooling apparatus, cooling of air compressed in the compressor is carried out by heat exchange with outside air. If outside air temperature rises to as high as 35 degrees centigrade in summer, it is impossible for the cooling apparatus to lower the temperature of the compressed air beyond about 40 degrees centigrade. Accordingly, in order to ensure cooling capacity even when outside air temperature is high, the compression ratio of the compressor must be increased. As a result, compressor driving power should be increased, giving rise to the problem of poor cooling efficiency, i.e., low COP (coefficient of performance).

Bearing in mind the above drawbacks with the prior art, the present invention was made. Accordingly, an object of the present invention is to provide an improved COP while at the same time maintaining the cooling capacity of an air cycle air-conditioning apparatus.

DISCLOSURE OF THE INVENTION

In the present invention, the temperature of cooled, compressed air is lowered and compressor driving power can be reduced while maintaining cooling capacity.

More specifically, the present invention discloses a first solution means which is directed to an air-conditioning apparatus for cooling room air by an air cycle employing air as a refrigerant, thereby performing air-cooling. The air-conditioning apparatus of the first solution means comprises a compressor (21) which draws in at least air in a room for compressing the drawn room air, a cooling means (30) which subjects the compressed air compressed in the compressor (21) to heat exchange with exhaust air expelled from the room for cooling the compressed air, and an expansion device (23) which provides-expansion of the compressed air cooled by the cooling means (30), wherein low-temperature air, cooled by the expansion in the expansion device (23), is delivered to the room.

Further, the present invention discloses a second solution means according to the first solution means in which a moisturizing means (41) is disposed which supplies moisture to the exhaust air that is delivered to the cooling means (30) for pre-cooling the exhaust air.

Further, the present invention discloses a third solution means according to the first solution means in which a moisturizing means (42) is disposed which supplies moisture to the exhaust air so that cooling of the compressed air is performed making utilization of a latent heat of vaporization of water in the cooling means (30).

Further, the present invention discloses a fourth solution means according to the second or third solution means in which, when the exhaust air is expelled from the cooling means (30), each moisturizing means (41, 42) supplies a specified amount of moisture to the exhaust air so that the exhaust air has a relative humidity in a range from not less than 80% to less than 100%.

Further, the present invention discloses a fifth solution means according to the second or third solution means in which each moisturizing means (41, 42) supplies moisture to the exhaust air through a moisture permeable membrane transmittable to moisture.

Further, the present invention discloses a sixth solution means according to the first solution means in which a demoisturizing means (22) is disposed which has a separation membrane and the separation membrane is formed such that water vapor in the air is allowed to pass therethrough from a high partial pressure of water-vapor side to a low partial pressure of water-vapor side thereof, for separation of water vapor contained in the compressed air without causing the water vapor to undergo condensation.

Further, the present invention discloses a seventh solution means according to the sixth solution means in which a depressurizing means (36) is disposed which provides depressurization of one of the sides of the separation membrane in the demoisturizing means (22) so as to ensure a difference in partial pressure of water-vapor between both the separation membrane sides.

Further, the present invention discloses an eighth solution means according to any one of the second to fifth solution means in which a demoisturizing means (22) is disposed which has a separation membrane and the separation membrane is formed such that water vapor in the air is allowed to pass therethrough from a high partial pressure of water-vapor side to a low partial pressure of water-vapor side thereof, for separation of water vapor contained in the compressed air without causing the water vapor to undergo condensation.

Further, the present invention discloses a ninth solution means according to the eighth solution means in which a depressurizing means (36) is disposed which provides depressurization of one of the sides of the separation membrane in the demoisturizing means (22) so as to ensure a difference in partial pressure of water-vapor between both the separation membrane sides.

Further, the present invention discloses a tenth solution means according to the sixth or eighth solution means in which the demoisturizing means (22) is formed so that one of surfaces of the separation membrane is brought into contact with the compressed air whereas the other of the surfaces is brought into contact with the exhaust air, whereby water vapor contained in the compressed air will travel to the exhaust air.

Further, the present invention discloses an eleventh solution means according to any one of the sixth to ninth solution means in which a part or all of moisture separated from the compressed air by the demoisturizing means (22) is supplied, together with low-temperature air from the expansion device (23), into the room.

Further, the present invention discloses a twelfth solution means according to the ninth solution means in which a part or all of moisture separated from the compressed air by the demoisturizing means (22) is supplied to the exhaust air by the moisturizing means (41, 42).

Further, the present invention discloses a thirteenth solution means according to any one of the sixth to twelfth solution means in which the separation membrane is composed of a polymeric membrane and formed so as to allow water vapor to pass therethrough by water-molecule diffusion in the membrane.

Further, the present invention discloses a fourteenth solution means according to any one of the sixth to twelfth solution means in which the separation membrane has a large number of pores having a size equal to a molecule free path and is formed so as to allow water vapor to pass therethrough by water-molecule capillary condensation and diffusion.

Further, the present invention discloses a fifteenth solution means according to any one of the first to fourteenth solution means in which the compressor (21) is so formed as to draw in room air and supply air that is supplied from the outside to the inside of the room.

Finally, the present invention discloses a sixteenth solution means according to any one of the first to fifteenth solution means in which low-temperature air from the expansion device (23) is mixed with room air and thereafter the mixture is-supplied into the room.

ACTION

In the first solution means, the compressor (21) compresses at least room air which then becomes high-pressure, compressed air. The compressed air is cooled in the cooling means (30) and thereafter expanded in the expansion device (23) to become low-temperature air. The low-temperature is supplied into the room for cooling thereof. Here, the temperature of exhaust air expelled from inside the room for the purpose of ventilation et cetera is approximately the same as room temperature, therefore being lower than outside air temperature. In the present solution means, in the cooling means (30) compressed air is cooled with exhaust air the temperature of which is lower than that of outside air.

Further, in the second solution means, the moisturizing means (41) supplies moisture to -exhaust air, so that the temperature of the exhaust air is made lower than that of room air by evaporation of the moisture supplied. And then, in the cooling means (30), the exhaust air, the temperature of which is lower than room temperature, is subjected to heat exchange with compressed air.

Further, in the third solution means, the moisturizing means (42) supplies moisture to exhaust air and the cooling means (30) utilizes a sensible heat of the exhaust air and a latent heat of vaporization of the moisture for compressed air cooling. That is, in the cooling means (30), the compressed air is cooled while on the other hand the exhaust air is heated, and the moisture supplied to the exhaust air is evaporated. At that time, the temperature rising of the exhaust air is suppressed by such moisture evaporation, thereby maintaining a difference in temperature between the exhaust air and the compressed air.

Further, in the fourth solution means, the moisturizing means (41, 42) supply a possible maximum amount of moisture to exhaust air in such a range that no condensation occurs in the exhaust air when it is expelled from the cooling means (30). Accordingly, compressed air cooling is carried out by making utilization of a latent heat of vaporization of the moisture to the full extent.

Further, in the fifth solution means, moisture is gradually supplied, through a specified moisture permeable membrane, to exhaust air by the moisturizing means (41, 42).

Further, in the sixth or eighth solution means, the demoisturizing means (22) removes moisture from the air compressed in the compressor (21). At that time, since the demoisturizing means (22) has a specified separation membrane, moisture in the compressed air is removed therefrom, still remaining in the form of water vapor.

Further, in the seventh or ninth solution means, depressurization provided by the depressurizing means (36) ensures creation of a difference in partial pressure of water-vapor between both the sides of the separation membrane. That is, one surface of the separation membrane comes into contact with compressed air and the other surface is subjected to depressurization by the depressurizing means (36). Accordingly, the partial pressure of water-vapor of the other surface side of the separation membrane is held lower than that of the compressed air.

Further, in the tenth solution means, one surface of the separation membrane is brought into contact with compressed air and the other surface thereof is brought into contact with exhaust air. Accordingly, in a running condition in which the exhaust air is lower in partial pressure of water-vapor than the compressed air, moisture in the compressed air travels to the exhaust air without any external action.

Further, in the eleventh solution means, moisture separated from compressed air is used for room humidification. Here, if moisture is separated from compressed air, this may result in gradual drop of the room humidity. On the other hand, in the present solution means, a part or all of moisture separated is brought back into the room, thereby providing protection against excessive drop in the room humidity.

Further, in the twelfth solution means, moisture separated from compressed air is supplied to exhaust air by the moisturizing means (41, 42) and a latent heat of vaporization of that moisture is utilized for cooling of compressed air in the cooling means (30).

Further, in the thirteenth or fourteenth solution means, the separation membrane is so formed by a given process so that it allows water vapor to pass therethrough.

Further, in the fifteenth solution means, supply air that is supplied from the outside to the inside of a room is supplied, together with room air, to the compressor (21). The supply air is for ventilation and the temperature of the supply air is substantially the same as outside air temperature. Together with the room air, the supply air flows through the compressor (21), through the cooling means (30), and through the expansion device (23) in that order. After it is cooled, the supply air is supplied into the room.

Further, in the sixteenth solution means, even when the temperature of the low-temperature air becomes considerably low depending upon the running condition, the low-temperature air is mixed with mixing air, whereby the temperature of the low-temperature air when it is supplied into the room will not become that low.

EFFECTS

In accordance with the above-described solution means, compressed air cooling is carried out using exhaust air. This makes it possible to cool the compressed air to lower temperatures when compared to cooling with outside air. Because of this, it is possible to achieve reduction in the input to the compressor (21) while maintaining cooling capacity, thereby providing an improved COP.

In respect to the above point, a description will be given with reference to a graph of FIG. 3. First, when compressed air is cooled with outside air, it is required that compression ratio be increased so that the compressed air becomes able to give off heat to the outside air. More specifically, it is required that the air be compressed from Point A to Point B', and a compression work of the compressor (21) is Wcom'. The compressed air is cooled from Point B' to Point C' and thereafter subjected to expansion from Point C' to Point D in the expansion device (23), thus becoming low-temperature air. At that time, a recovery work of the expansion device (23) is Wexp'. Therefore, the input required is (Wcom'−Wexp').

On the other hand, when compressed air is cooled with exhaust air the temperature of which is lower than that of outside air, this enables the compressed air to give off heat to the exhaust air even at low compression ratio. More specifically, compression of the air from Point A to Point B will suffice, and a compression work of the compressor (21) is Wcom. The compressed air is cooled down from Point B to Point C and thereafter subjected to expansion from Point C to Point D in the expansion device (23), thus becoming low-temperature air. At that time, a recovery work of the expansion device (23) is Wexp. Therefore, the input required is (Wcom−Wexp).

Accordingly, if compressed air is cooled with exhaust air, this reduces the required input from (Wcom'−Wexp') to (Wcom−wexp). In both of the cases, the cooling capacity is Qref. Here, COP is found by dividing cooling capacity by input. Accordingly, the arrangement that compressed air is cooled with exhaust air makes it possible to achieve reduction in the input while maintaining cooling capacity, thereby achieving an improved COP.

Further, in accordance with the second solution means, it is possible to perform cooling of compressed air with exhaust air whose temperature has been further lowered in comparison with room temperature. Because of this, it is possible to cool the compressed air to further lower temperatures, thereby achieving a further improved COP.

Further, in accordance with the third solution means, it is possible to suppress the temperature rising of exhaust air in the cooling means (30) by evaporation of the moisture supplied. This makes it possible to maintain a temperature difference between the exhaust air and the compressed air, therefore promoting the transfer of heat from the compressed air to the exhaust air. As a result, it is possible to cool the compressed air to a further lower temperature, thereby achieving a further improved COP.

Further, in accordance with the fourth solution means, moisture evaporation latent heat is utilized to the full in such a range that no condensation occurs in the exhaust air, for compressed air cooling. Because of this, it is possible to cool compressed air by making utilization of moisture evaporation latent heat without the necessity to process drain water.

Further, in accordance with the fifth solution means, moisture is supplied little by little to the exhaust air, thereby ensuring that the moisture supplied is evaporated positively in the exhaust air. As a result, the moisture supplied into the exhaust air will not remain in the phase of liquid. Accordingly, moisture evaporative latent heat is utilized to the full for compressed air cooling without taking into consideration the processing of drain at all.

Further, in accordance with the sixth or eighth solution means, it is possible to deliver, after separation of moisture from compressed air, the compressed air to the expansion device (23). This makes it possible to provide expansion of the compressed air that does not contain therein much moisture, thereby preventing the occurrence of condensation in the post-expansion low-temperature air. As a result, it becomes possible to perform room cooling while preventing emission of liquid droplets together with low-temperature air into the room.

Further, in accordance with the present solution means, it is possible to separate moisture from the compressed air in the form of water vapor without the occurrence of condensation. As a result, it is possible to increase cooling capacity, thereby achieving an improved COP.

In respect to the above point, a description will be given with reference to a graph of FIG. 4. First, when moisture is not removed from the compressed air, a refrigeration cycle in such a case is indicated by Point A, Point B, Point C', and Point D', and the cooling capacity is Qref'. On the other hand, when moisture is separated from the compressed air in the form of water vapor, it is possible to lower the enthalpy of the post-cooling compressed air by enthalpy held by the separated water vapor. More specifically, the compressed air can be placed in the state of Point C and a refrigeration cycle in this case is indicated by Point A, Point B, Point C, and Point D, and the cooling capacity is Qref. Both the cases are substantially identical not only in the compression work of the compressor (21) but also in the recovery work of the expansion device (23), so that the input varies little. Accordingly, it is possible to increase the cooling capacity from Qref' to Qref without increasing the input, thereby achieving an improved COP.

Further, in accordance with the seventh or ninth solution means, it is possible to ensure, in any operating condition, a difference in partial pressure of water-vapor between both the sides of the separation membrane by the depressurization means (36). Accordingly, it is possible to separate water vapor from the compressed air at all times by the separation membrane, thereby making it possible to provide stable running operations while achieving an improved COP. Further, even during start-up it is possible to ensure a difference in partial pressure of water-vapor between both the sides of the separation membrane. Accordingly, in accordance with the present solution means, it is possible to shorten the time taken to achieve sufficient cooling capacity from the start time.

Further, in accordance with the tenth solution means, it is possible to expel water vapor separated from compressed air to the outside of the room, together with exhaust air. This eliminates the need for a structure for processing the water vapor separated, therefore achieving structure simplification.

Further, in accordance with the eleventh solution means, it is possible to provide protection against excessive drop in room humidity, thereby making it possible to maintain not only room temperature but also room humidity in specified ranges to improve the comfortability of the person present in the room.

Further, in accordance with the twelfth solution means, it is possible to use moisture separated from compressed air for cooling of the compressed air in the cooling means (30). As a result, it becomes possible to reduce the amount of water required for running operations.

Further, in accordance with the thirteenth or fourteenth solution means, it is possible to ensure that a separation membrane having a specified function is formed positively.

Further, in accordance with the fifteen solution means, it is possible to perform operations in which both room air and supply air are used as a refrigerant.

Further, in accordance with the sixteenth solution means, it is possible to prevent the temperature of air that is emitted into the room from becoming too low, thereby maintaining the comfortability of the person present in the room.

BEST MODE FOR CARRYING OUT THE INVENTION

Hereinafter, an embodiment of the present invention will be described in detail by making reference to the accompanying drawings.

Figure 1:
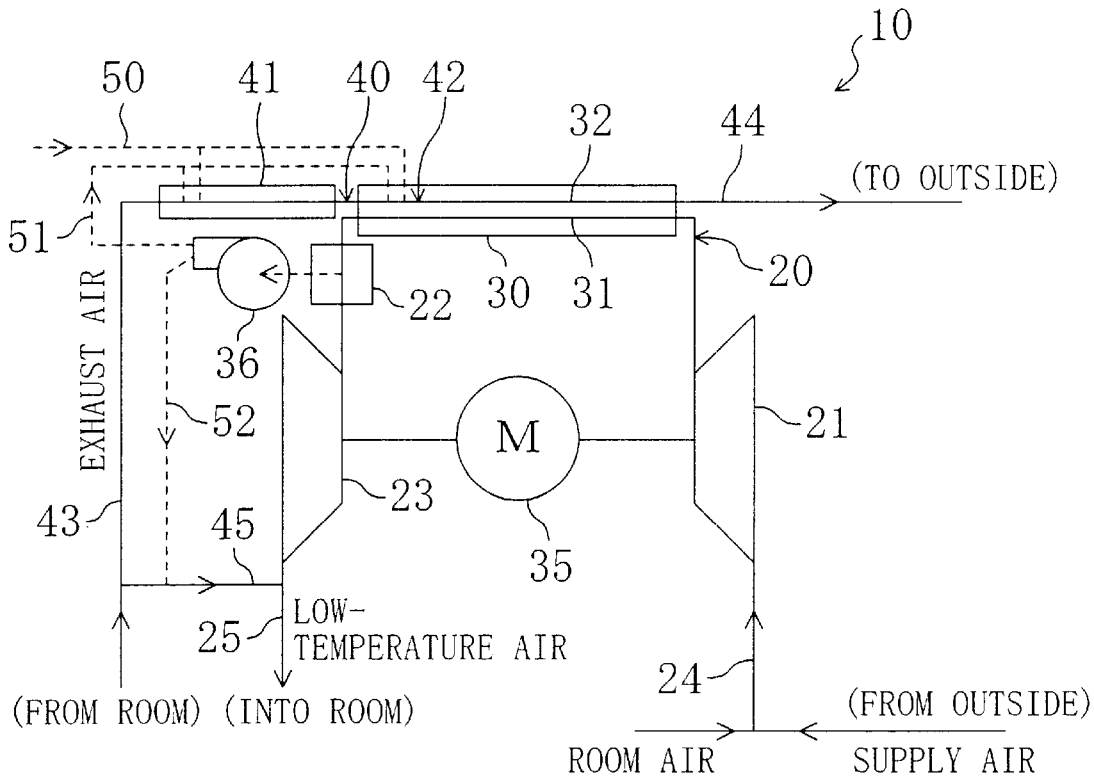
FIG. 1 is a schematic arrangement diagram showing an arrangement of an air-conditioning apparatus in accordance with an embodiment of the present invention.

As shown in FIG. 1, an air-conditioning apparatus (10) of the present embodiment is made up of a cycle-side system (20) and an exhaust heat-side system (40).

The cycle-side system (20) is formed by establishing sequential duct connection of a compressor (21), a heat exchanger (30), a demoisturizer (22), and an expansion device (23), for performing refrigeration operations by an air cycle. In addition, the cycle-side system (20) further includes a suction duct (24) connected to the inlet side of the compressor (21) and an emission duct (25) connected to the outlet side of the expansion device (23). The suction duct (24) is constructed such that it is divided, at its leader end side, into two branches, whereby room air and supply air for ventilation supplied from the outside of a room are delivered to the compressor (21). Further, the emission duct (25) is so formed as to guide low-temperature air from the expansion device (23) into the room.

The exhaust heat-side system (40) is formed by establishing duct connection of a humidifying cooler (41) and the heat exchanger (30) and includes an inlet duct (43) connected to the humidifying cooler (41) and an outlet duct (44) connected to the heat exchanger (30). The inlet duct (43) opens, at its one end, to the room and is connected, on the way to the humidifying cooler (41), to a branch duct (45) which is connected, at its one end, to the emission duct (25). The inlet duct (43) is constructed so that, of the room air flowing therethrough, a part thereof is guided to the humidifying cooler (41) as exhaust air that is expelled out of the room for ventilation and the remaining air is delivered to the emission duct (25). Moreover, the outlet duct (44) opens, at its one end, to the outside of the room, whereby exhaust air from the heat exchanger (30) is expelled to the outside of the room.

Connected to the compressor (21) is a motor (35). Further, the compressor (21) is connected to the expansion device (23). The compressor (21) is so configured as to be driven by driving force by the motor (35) and by expansion operation when air is expanded in the expansion device (23).

Zone formed in the heat exchanger (30) are a compressed air passageway (31) through which compressed air flows and an exhaust air passageway (32) through which exhaust air flows. The compressed air passageway (31) is duct connected, at its one end, to the compressor (21), whereas the other end thereof is connected to the demoisturizer (22). On the other hand, the exhaust air passageway (32) is duct connected, at its one end, to the humidifying cooler (41), whereas the other end thereof is connected to the outlet duct (44). The heat exchanger (30) is so configured as to perform heat exchange between compressed air of the compressed air passageway (31) and exhaust air of the exhaust air passageway (32). That is, the heat exchanger (30) constitutes a cooling means for cooling the compressed air by heat exchange with the exhaust air.

Further, mounted in the heat exchanger (30) is a humidifying part (42). In the humidifying part (42), the exhaust air passageway (32) is formed of a moisture permeable membrane and a water-side space is defined opposite across the moisture permeable membrane. Connected to the water-side space is a water supplying pipe (50) and tap water or the like is supplied, through the water supplying pipe (50), to the water-side space. In addition, the moisture permeable membrane is formed so that it allows moisture to pass therethrough, wherein moisture in the water-side space penetrates through the moisture permeable membrane to exhaust air in the exhaust air passageway (32).

The moisture supplied by the humidifying part (42) evaporates in the exhaust air, thereby suppressing the temperature rising of the exhaust air that is subjected to heat exchange with the compressed air. This ensures a difference in temperature between the exhaust air and the compressed air. That is, the humidifying part (42) constitutes a moisturizing means capable of a supply of moisture to the exhaust air for cooling the compressed air by making utilization of a latent heat of vaporization.

Furthermore, the humidifying part (42) supplies a specified amount of moisture to the exhaust air so that the exhaust air at the exit of the exhaust air passageway (32) of the heat exchanger (30) has a humidity in a range from not less than 80% to less than 100%. As a result of such arrangement, moisture is supplied to exhaust air in such a range that no condensation occurs in the exhaust air when discharged to the outside of the room.

The demoisturizer (22) has a separation membrane. Separated by the separation membrane are a high-pressure space and a low-pressure space. The high-pressure space is duct connected, at its inlet side, to the compressed air passageway (31) of the heat exchanger (30) whereas the outlet side thereof is duct connected to the expansion device (23). Accordingly, compressed air cooled in the heat exchanger (30) flows into the high-pressure space. In the demoisturizer (22), water vapor in the compressed air penetrates through the separation membrane, as a result of which the water vapor travels from the high-pressure space side to the low-pressure space side. That is, the demoisturizer (22) constitutes a demoisturizing means capable of removal of moisture from the compressed air.

The separation membrane is implemented by a polymeric membrane such as fluororesin. The separation membrane is so constructed as to allow water vapor to pass therethrough by water molecule diffusion through the membrane inside. Further, the separation membrane may be formed of a porous membrane for gas separation formed of xerogel et cetera. In this case, the moisture in the compressed air penetrates through the separation membrane by capillary condensation and diffusion of water molecule.

The humidifying cooler (41) has a moisture permeable membrane. Separated by the moisture permeable membrane are an air-side space and a water-side space. The air-side space is duct connected, at its inlet side, to the inlet duct (43) whereas the outlet side thereof is duct connected to the exhaust air passageway (32) of the heat exchanger (30). Accordingly, exhaust air flows into the air-side space. Moreover, the water supplying pipe (50) is connected to the water-side space and tap water et cetera is supplied, through the water supplying pipe (50), to the water-side space. On the other hand, the moisture permeable membrane is formed so that it allows moisture to pass therethrough. As a result, moisture in the water-side space penetrates through the moisture permeable membrane, thus being supplied to the exhaust air in the air-side space. The humidifying cooler (41) is so configured as to lower the temperature of exhaust air by evaporation of the moisture supplied to the exhaust air. That is, the humidifying cooler (41) constitutes a moisturizing means for pre-cooling exhaust air and delivering the same to the heat exchanger (30).

Connected to the low-pressure space of the demoisturizer (22) is a vacuum pump (36). The vacuum pump (36) is disposed for providing depressurization of the low-pressure space, which constitutes a depressurizing means for ensuring a difference in partial pressure of water-vapor between the low-pressure space and the high-pressure space.

Further, connected to the outlet side of the vacuum pump (36) is a first water line (51) and a second water line (52). The first water line (51) is connected to the water-side space of the humidifying cooler (41) and to the water-side space of the humidifying part (42) of the heat exchanger (30), for supplying moisture separated from compressed air in the demoisturizer (22) to both the water-side spaces. On the other hand, the second water line (52) is connected to the branch duct (45), for supplying, together with room air, moisture separated from compressed air in the demoisturizer (22) into low-temperature air within the emission duct (25).

RUNNING OPERATION

Figure 2:
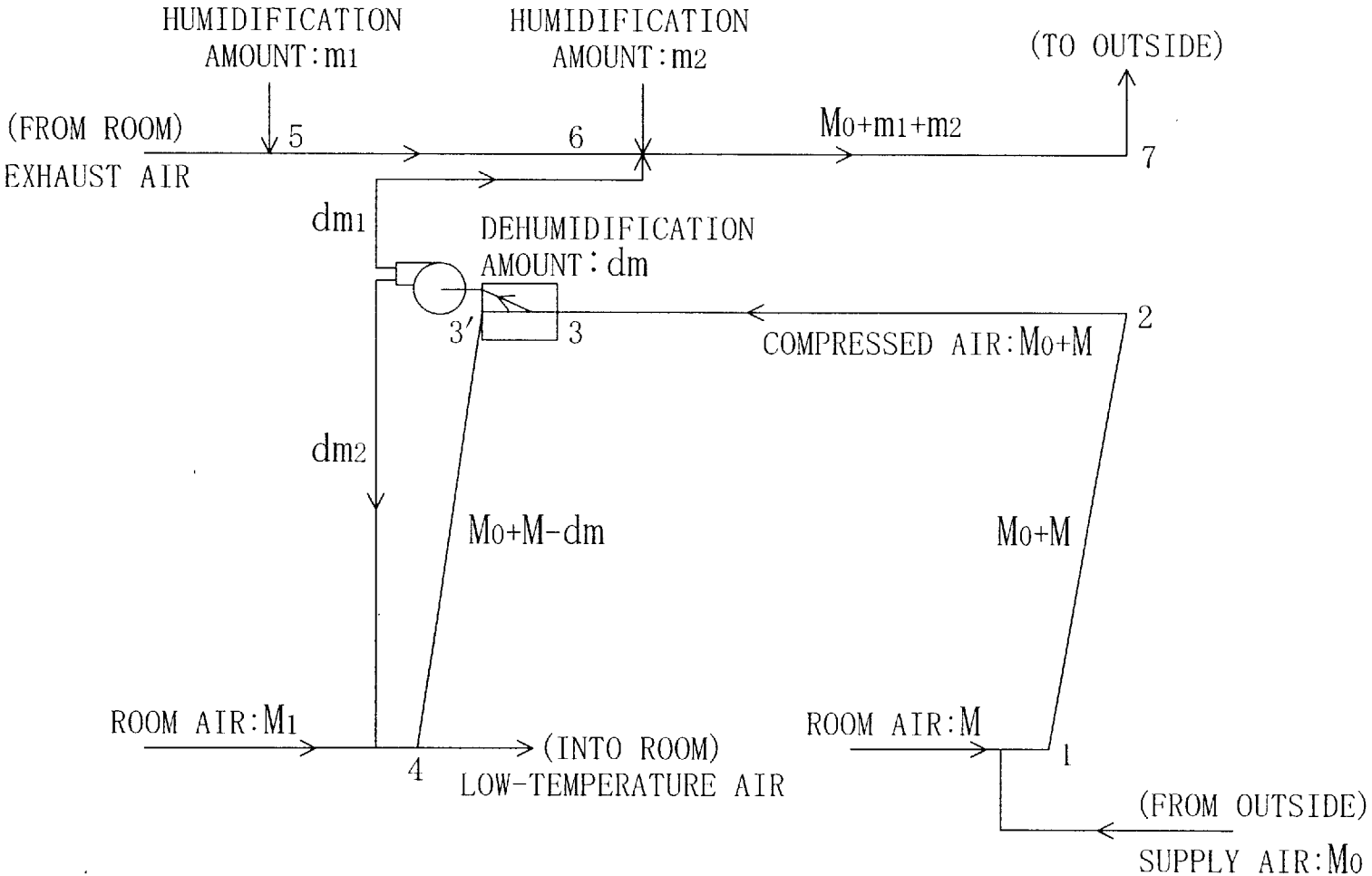
FIG. 2 is an air state-diagram showing the operation of the air-conditioning apparatus of the embodiment.
Figure 3:
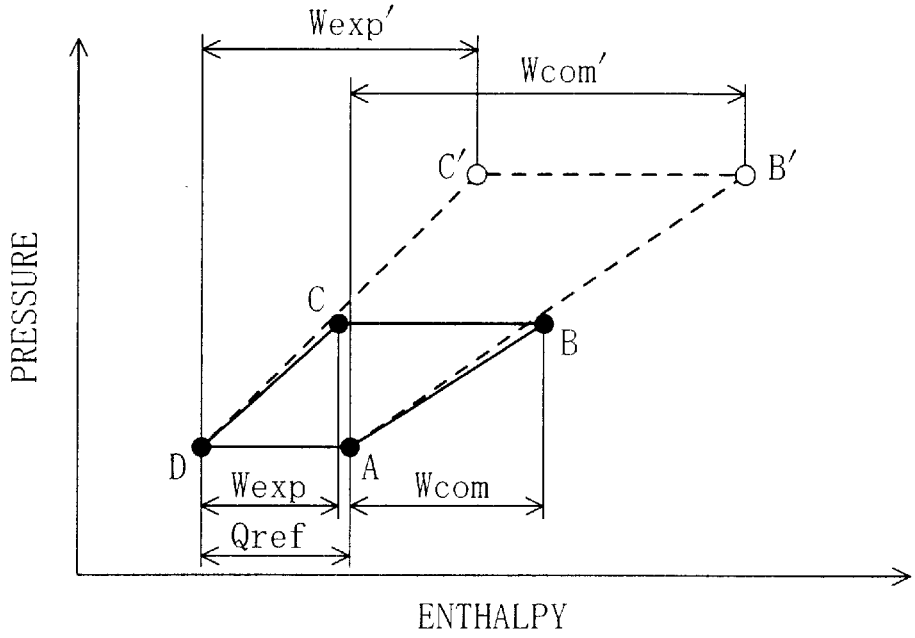
FIG. 3 is a characteristic diagram showing a relationship between the pressure and the enthalpy in an air cycle for providing a description of the fact that COP is improved by lowering the temperature of compressed air.
Figure 4:
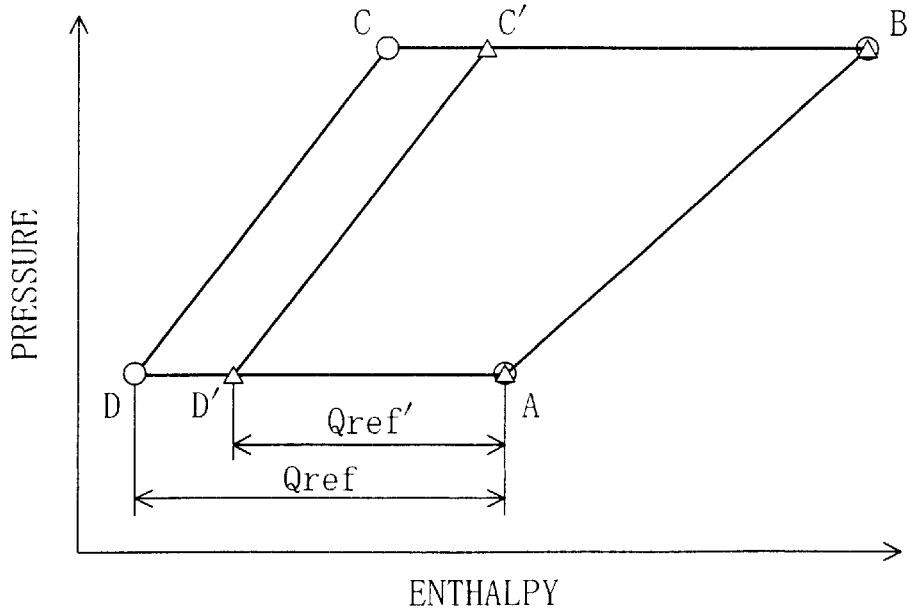
FIG. 4 is a characteristic diagram showing a relationship between the pressure and the enthalpy in an air cycle for providing a description of the fact that the cooling capacity is improved by separation of water vapor from compressed air.

Next, running operation of the air-conditioning apparatus (10) will be explained with reference to FIG. 2. When in the cycle-side system (20) the compressor (21) is driven by the motor (35), room air and supply air are fed to the compressor (21) through the suction duct (24). More specifically, supply air (flow rate: MO) and room air (flow rate: M) are mixed with each other and the mixture is supplied to the compressor (21). In the compressor (21), the air thus supplied is subjected to compression in a range from Point 1 to Point 2, thereby generating compressed air of a flow rate of MO+M. The compressed air is delivered to the compressed air passageway (31) of the heat exchanger (30).

In the heat exchanger (30), while the compressed air is flowing through the compressed air passageway (31) it exchanges heat with exhaust air of the exhaust air passageway (32). Because of this, the compressed air is cooled in a range from Point 2 to Point 3. The compressed air thus cooled is directed to the high-pressure space of the demoisturizer (22).

In the demoisturizer (22), moisture: dm is removed from the compressed air in a range from Point 3 to Point 3' and the enthalpy of the compressed air falls. More specifically, in the demoisturizer (22), the low-pressure space is depressurized by the vacuum pump (36), so that the partial pressure of water-vapor of the low-pressure space is maintained lower than that of the high-pressure space at all times. The difference in partial pressure of water-vapor between both the spaces allows water vapor in the compressed air to penetrate through the separation membrane for removal of the moisture in the compressed air. At that time, the water vapor in the compressed air is separated from the compressed air in the form of water vapor without undergoing condensation. Accordingly, there is a corresponding drop in enthalpy of the compressed air to the enthalpy of the separated water vapor.

Thereafter, the compressed air is delivered to the expansion device (23). In the expansion device (23), the compressed air is expanded in a range from Point 3' to Point 4, thereby becoming low-temperature air. Then, the low-temperature air is supplied, through the emission duct (25), into the room, whereby the room is cooled. At that time, room air is delivered, through the branch duct (45), into the emission duct (25). Accordingly, the low-temperature air, mixed with a specified amount of room air, is supplied into the room.

On the other hand, in the exhaust heat-side system (40), exhaust air (flow rate: MO) is delivered, through the inlet duct (43), to the air-side space of the humidifying cooler (41). That is, exhaust air whose flow rate is the same as that of the supply air is delivered to the humidifying cooler (41).

In the humidifying cooler (41), moisture (flow rate: m1) is supplied to the exhaust air at Point 5 and the moisture supplied is evaporated in the exhaust air. Because of this, the temperature of the exhaust air becomes lower than room temperature. Then, the temperature-lowered exhaust air is delivered to the exhaust air passageway (32) of the heat exchanger (30).

In the exhaust air passageway (32) of the heat exchanger (30), the exhaust air is subjected to heat exchange with the compressed air of the compressed air passageway (31) in a range from Point 6 to Point 7. That is, in the heat exchanger (30), the compressed air is cooled by the low-temperature exhaust air from the humidifying cooler (41).

Further, in the heat exchanger (30), moisture (flow rate: m2) is supplied to exhaust air in the exhaust air passageway (32) in the humidifying part (42). The moisture thus supplied evaporates in the exhaust air in the exhaust air passageway (32), thereby suppressing the temperature rising of the exhaust air. This accordingly maintains a difference in temperature between the compressed air and the exhaust air in the heat exchanger (30), thereby ensuring that the compressed air is cooled positively.

Here, in the present embodiment, a mixture of room air and supply air for ventilation flows through the cycle-side system (20) and, on the other hand, only exhaust air for ventilation flows through the exhaust heat-side system (40). Accordingly, in the heat exchanger (30), heat exchange between compressed air (flow rate: MO+M) and exhaust air (flow rate: MO) is carried out. That is, cooling of compressed air is performed with exhaust air having a flow rate less than that of the compressed air, which may result in insufficient cooling of the compressed air.

However, in the present embodiment, there is provided a supply of moisture to the exhaust air in the humidifying cooler (41) as well as in the humidifying part (42). As a result of such arrangement, the -thermal capacity of the exhaust air within the exhaust air passage way (32) increases by the enthalpy of the water vapor supplied (flow rate: m1+m2). Accordingly, in the present embodiment, it is possible to sufficiently cool the compressed air, only by a flow of exhaust air for ventilation through the exhaust air-side system (40).

Further, the humidifying part (42) supplies a specified amount of moisture to exhaust air so that the exhaust air has, at the exit of the exhaust air passageway (32), a humidity in a range from not less than 80% to less than 100%. That is, a supply of moisture to the exhaust air is provided in such a range that no condensation occurs in the exhaust air when discharged to the outside of the room. Accordingly, a latent heat of vaporization of water is utilized to the full for compressed air cooling while making the processing of drain unnecessitated.

Thereafter, the exhaust air, which has exchanged heat with the compressed air in the heat exchanger (30), is expelled, by way of the outlet duct (44), to the outside of the room. That is, in the present embodiment, compressed air cooling is carried out by making utilization of exhaust air that is expelled for effecting ventilation from the inside to the outside of the room.

Further, of the moisture separated from the compressed air in the demoisturizer (22), a part thereof flows into the first water line (51) whereas the remaining part flows into the second water line (52). The moisture now flowing in the first water line (51) is further divided into two streams, i.e., one that is guided to the water-side space of the humidifying cooler (41) and the other that is guided to the water-side space of the humidifying part (42) of the heat exchanger (30). Then, the moisture directed to the humidifying cooler (41) is supplied, through the moisture permeable membrane, to exhaust air and utilized there for cooling of the exhaust air. On the other hand, the moisture directed to the humidifying part (42) is supplied, through the moisture permeable membrane, to exhaust air and utilized there for suppressing the temperature rising of the exhaust air in the heat exchanger (30). Moreover, the moisture now flowing in the second water line (52) is directed into the branch duct (45) and supplied, together with room air and low-temperature air, into the room for humidification of the room.

EFFECTS OF THE EMBODIMENTS

In the present embodiment, exhaust air, the temperature of which is lower than outside air temperature, is further cooled in the humidifying cooler (41) and thereafter subjected to heat exchange with the compressed air in the heat exchanger (30). As a result of such arrangement, it becomes possible to cool the compressed air to lower-temperatures than performing cooling with outside air. Moreover, the temperature rising of exhaust air in the heat exchanger (30) is suppressed by the humidifying part (42) of the heat exchanger (30). As a result of such arrangement, it becomes possible to maintain a difference in temperature between the exhaust air and the compressed air, thereby promoting the transfer of heat from the compressed air to the exhaust air.

Accordingly, the present embodiment ensures that compressed air compressed in the compressor (21) is positively cooled down to further lower temperatures. Because of this, it is possible to reduce the compression ratio of the compressor (21) while at the same time maintaining cooling capacity, and reduction in the input to the compressor (21) is achieved. This makes it possible to provide an improved COP.

Furthermore, in the present embodiment, exhaust air that is expelled from the room for effecting ventilation is utilized for compressed air cooling. Exhaust air is not simply expelled to the outside of the room, that is, cold of the exhaust air is recovered to the compressed air. Because of this, room ventilation can be carried out without having to increase room air-conditioning load to a greater extent, thereby making it possible to reduce energy loss.

Further, by virtue of the humidifying part (42) of the heat exchanger (30), moisture evaporation latent heat is utilized to the full in such a range that no condensation occurs in the exhaust air, for compressed air cooling. Because of this, it is possible to achieve compressed air cooling by making utilization of a latent heat of vaporization of moisture without having to process drain water.

In addition, in the present embodiment, compressed air is cooled with exhaust air the flow rate of which is lower than that of the compressed air. However, as describe above, since it is possible to achieve cooling of the compressed air by making utilization of a latent heat of vaporization of the moisture supplied to the exhaust air, this makes it possible to cool the compressed air to a sufficiently low temperature, even in such a case.

Further, the humidifying cooler (41) and the humidifying part (42) of the heat exchanger (30) each are formed so as to gradually supply moisture to exhaust air through the moisture permeable membrane. This arrangement therefore makes it possible to cause the moisture thus supplied to be evaporated positively in the exhaust air and, as a result, the moisture supplied into the exhaust air will not remain in the phase of liquid. Accordingly, the latent heat of vaporization of the moisture is utilized to the full for compressed air cooling without taking into consideration drain processing at all.

Additionally, it is possible to deliver, after performing separation of moisture from compressed air by the demoisturizer (22), the compressed air to the expansion device (23). This therefore makes it possible to cause the compressed air low in moisture content to expand, thereby providing protection against the occurrence of condensation in the post-expansion low-temperature air. As a result, it becomes possible to cool the room while preventing liquid droplets from being emitted, together with low-temperature air, into the room.

Further, in accordance with the demoisturizer (22), it is possible to separate moisture from compressed air in the form of water vapor without condensation. Because of this, it is possible to lower the enthalpy of compressed air that is delivered to the expansion device (23) to a further extent. This therefore increases cooling capacity, thereby providing a further improved COP.

In addition, the low-pressure space of the demoisturizer (22) is depressurized by the vacuum pump (36), thereby making it possible to ensure a different in partial pressure of water-vapor between the low-pressure space and the high-pressure space at all times. Accordingly, water vapors in the compressed air penetrate through the separation membrane at all times, so that separation of water vapor from compressed air can be carried out positively. As a result, it is possible to provide an improved COP. Further, also during start-up, it is possible to ensure a difference in partial pressure of water-vapor between both the sides of the separation membrane, thereby making it possible to shorten the time taken to provide sufficient cooling capacity from the start-up.

Further, moisture separated from compressed air is supplied to low-temperature air through the second water line (52). This provides protection against excessive drop in room humidity, thereby making it possible to maintain not only room temperature but also room humidity in specified ranges to improve comfortability of the person present in the room.

Additionally, moisture separated from compressed air is supplied, through the first water line (51), to the humidifying cooler (41) and to the humidifying part (42). And then, the moisture can be supplied to the exhaust air in the humidifying cooler (41) and in the humidifying part (42) and it is possible to make use of moisture separated from compressed air for providing compressed air cooling in the heat exchanger (30). As a result, it becomes possible to reduce the amount of water required for running operations.

Further, it is arranged such that a mixture of low-temperature air and room air is supplied into the room. This provides protection against excessive drop in the temperature of air that is emitted into the room, thereby making it possible to maintain comfortability of the person present in the room.

FIRST VARIATION

In the above-described embodiment, low-temperature air from the expansion device (23) and room air are mixed together and supplied into the room. Instead of such arrangement, only low-temperature air may be supplied into the room. That is, there are cases in which the temperature of low-temperature air dose not become so low depending upon the running condition (for example, about 15 degrees centigrade). In such a case, even when only low-temperature air is supplied into the room, there is no danger of causing discomfort to the person present in the room. Accordingly, only low-temperature air may be sent out to the room without being mixed with room air.

SECOND VARIATION

Further, in the above-described embodiment, moisture separated from compressed air in the demoisturizer (22) is supplied to exhaust air through the first water line (51) and to low-temperature air through the second water line (52). However, the moisture is not necessarily supplied to both of the exhaust air and the low-temperature air. The moisture may be supplied either to the exhaust air or to the low-temperature air.

THIRD VARIATION

Further, in the above-described embodiment, moisture separated from compressed air in the demoisturizer (22) is supplied to the humidifying cooler (41) and to the humidifying part (42). However, an arrangement may be made in which one end of the first water line (51) is connected to the inlet duct (43) and the separated moisture is supplied to exhaust air within the inlet duct (43). Further, another arrangement may be made in which one end of the first water line (51) is connected to the outlet duct (44) and the separated moisture is supplied to exhaust air which has exchanged heat with compressed air in the heat exchanger (30).

FOURTH VARIATION

Further, in the above-described embodiment, the demoisturizer (22) is interposed between the heat exchanger (30) and the expansion device (23) in the cycle-side system (20). However, an arrangement may be made in which the demoisturizer (22) is interposed between the compressor (21) and the heat exchanger (30) and moisture is separated from compressed air prior to cooling by the heat exchanger (30). Furthermore, like the third variation, in the present variation moisture separated from compressed air may be supplied either to exhaust air within the inlet duct (43) or to exhaust air within the outlet duct (44).

FIFTH VARIATION

Moreover, in the above-described embodiment, the low-pressure space of the demoisturizer (22) is subjected to depressurization by the vacuum pump (36) and moisture separated from compressed air by the demoisturizer (22) is utilized for room humidification, exhaust air cooling, et cetera. However, an arrangement may be made in which the vacuum pump (36) is not provided and the configuration of the demoisturizer (22) is changed so that water vapor in compressed air passes through the separation membrane and moves to exhaust air.

That is, defined in the demoisturizer are a cycle-side space and an exhaust heat-side space which are separated from each other by a separation membrane. Compressed air cooled in the heat exchanger (30) is directed to the cycle-side space. On the other hand, the inlet duct (43) of the exhaust heat-side system (40) is connected to the exhaust heat-side space and the exhaust heat-side space is defined at a halfway portion of the inlet duct (43). In such a case, only the water supply pipe (50) is connected to the humidifying cooler (41) and to the humidifying part (42) so that only tap water et cetera from the outside is supplied to the humidifying cooler (41) and to the humidifying part (42).

Owing to the difference in partial pressure of water-vapor created between the cycle-side space and the exhaust heat-side space, water vapor in compressed air penetrates through the separation membrane and travels to exhaust air. Thereafter, the water vapor thus separated is expelled to the outside of the room, together with the exhaust air. Accordingly, the present variation makes drain processing unnecessitated.

INDUSTRIAL APPLICABILITY

As described above, the air-conditioning apparatus of the present invention is useful for room cooling and particularly applicable to air cycle cooling.

What is claimed is:

1. An air-conditioning apparatus which cools room air by an air cycle employing air as a refrigerant for performing air-cooling, comprising:

means for directing room air to the apparatus;

a compressor which draws in the room air for compressing said drawn room air;

cooling means which subjects said compressed air compressed in said compressor to heat exchange with exhaust air expelled from the room for cooling said compressed air;

means for delivering exhaust air to said cooling means;

moisturizing means which supplies moisture to said exhaust air that is delivered to said cooling means for pre-cooling said exhaust air, wherein when said exhaust air is expelled from said cooling means said moisturizing means supplies a specified amount of moisture to said exhaust air so that said exhaust air has a relative humidity in a range from not less than 80% to less than 100%; and an expansion device which provides expansion of said compressed air cooled by said cooling means wherein low-temperature air cooled by said expansion in said expansion device is delivered into the room.

2. An air-conditioning apparatus which cools room air by an air cycle employing air as a refrigerant for performing air-cooling, comprising:

means for directing room air to the apparatus;

a compressor which draws in the room air for compressing said drawn room air;

moisturizing means which supply moisture to said exhaust air that is delivered to said cooling means for pre-cooling said exhaust air, wherein said moisturizing means supplies moisture to said exhaust air through a moisture permeable membrane transmittable to moisture;

cooling means which subject said compressed air compressed in said compressor to heat exchange with exhaust air expelled from the room for cooling said compressed air;

means for delivering exhaust air to said cooling means; and an expansion device which provides expansion of said compressed air cooled by said cooling means, wherein low-temperature air cooled by said expansion in said expansion device is delivered into the room.

3. An air-conditioning apparatus which cools room air by an air cycle employing air as a refrigerant for performing air-cooling, comprising:

means for directing room air to the apparatus;

a compressor which draws in the room air for compressing said drawn room air;

cooling means which subject said compressed air compressed in said compressor to heat exchange with exhaust air expelled from the room for cooling said compressed air;

means for delivering exhaust air to said cooling means;

an expansion device which provides expansion of said compressed air cooled by said cooling means, wherein low-temperature air cooled by expansion in said expansion device is delivered into the room; and demoisturizing means which has a separation membrane, said separation membrane being formed such that water vapor in the air is allowed to pass therethrough from a high partial pressure of water-vapor side to a low partial pressure of water-vapor side thereof, for separation of water vapor contained in said compressed air without causing said water vapor to undergo condensation.

4. The air-conditioning apparatus of claim 3, further comprising depressurizing means which provides depressurization of one of said sides of said separation membrane in said demoisturizing means so as to ensure a difference in partial pressure of water-vapor between both said separation membrane sides.

5. The air-conditioning apparatus of claim 4, further comprising moisturizing means which supplies moisture to said exhaust air that is delivered to said cooling means for pre-cooling said exhaust air.

6. The air-conditioning apparatus of claim 5, wherein a part or all of moisture separated from said compressed air by said demoisturizing means is supplied to said exhaust air by said moisturizing means.

7. The air-conditioning apparatus of claim 4, further comprising moisturizing means which supplies moisture to said exhaust air so that cooling of said compressed air is performed making utilization of a latent heat of vaporization of water in said cooling means.

8. The air-conditioning apparatus of claim 7, wherein a part or all of moisture separated from said compressed air by said demoisturizing means is supplied to said exhaust air by said moisturizing means.

9. The air-conditioning apparatus of claim 3, wherein said demoisturizing means is formed so that one of the surfaces of said separation membrane is brought into contact with said compressed air, and whereas the other of said surfaces is brought into contact with said exhaust air whereby water vapor contained in said compressed air will travel to said exhaust air.

10. The air-conditioning apparatus of claim 3, wherein a part or all of the moisture separated from said compressed air by said demoisturizing means is supplied together with low-temperature air from said expansion device into said room.

11. The air-conditioning apparatus of claim 3, wherein said separation membrane is composed of a polymeric membrane and formed so as to allow water vapor to pass therethrough by water-molecule diffusion in said membrane.

12. The air-conditioning apparatus of claim 3, wherein said separation membrane has a large number of pores having a size equal to a molecule free path and is formed so as to allow water vapor to pass therethrough by water-molecule capillary condensation and diffusion.

13. An air-conditioning apparatus which cools room air by an air cycle employing air as a refrigerant for performing air-cooling, comprising:

means for directing room air to the apparatus;

a compressor which draws in the room air for compressing said drawn room air, wherein said compressor is so formed as to draw in room air and supply air that is supplied from the outside to the inside of said room;

cooling means which subject said compressed air compressed in said compressor to heat exchange with exhaust air expelled from the room for cooling said compressed air;

means for delivering exhaust air to said cooling means; and an expansion device which provides expansion of said compressed air cooled by said cooling means, wherein low-temperature air cooled by said expansion in said expansion device is delivered into the room.

14. An air-conditioning apparatus which cools room air by an air cycle employing air as a refrigerant for performing air-cooling, comprising:

means for directing room air to the apparatus;

a compressor which draws in the room air for compressing said drawn room air;

cooling means which subject said compressed air compressed in said compressor to heat exchange with exhaust air expelled from the room for cooling said compressed air;

means for delivering exhaust air to said cooling means; and an expansion device which provides expansion of said compressed air cooled by said cooling means, wherein low-temperature air from said expansion device is mixed with room air and thereafter said mixture is supplied into said room.

15. An air-conditioning apparatus which cools room air by an air cycle employing air as a refrigerant for performing air-cooling, comprising:

means for directing room air to the apparatus;

a compressor which draws in the room air for compressing said drawn room air;

cooling means which subjects said compressed air compressed in said compressor to heat exchange with exhaust air expelled from the room for cooling said compressed air;

means for delivering exhaust air to said cooling means;

moisturizing means which supply moisture to said exhaust air so that cooling of said compressed air is performed making utilization of a latent heat of vaporization of water in said cooling means, wherein when said exhaust air is expelled from said cooling means said moisturizing means supplies a specified amount of moisture to said exhaust air so that said exhaust air has a relative humidity in a range from not less than 80% to less than 100%; and an expansion device which provides expansion of said compressed air cooled by said cooling, wherein low-temperature air from said expansion device is mixed with room air and thereafter said mixture is supplied into the room.

16. An air-conditioning apparatus which cools room air by an air cycle employing air as a refrigerant for performing air-cooling, comprising:

means for directing room air to the apparatus;

a compressor which draws in the room air for compressing said drawn room air;

cooling means which subjects said compressed air compressed in said compressor to heat exchange with exhaust air expelled from the room for cooling said compressed air;

means for delivering exhaust air to said cooling means;

moisturizing means which supply moisture to said exhaust air through a moisture permeable membrane transmittable to moisture, so that cooling of said compressed air is performed making utilization of a latent heat of vaporization of water in said cooling means; and an expansion device which provides expansion of said compressed air cooled by said cooling means, wherein low-temperature air cooled by said expansion in said expansion device is delivered into the room.

* * * * *

UNITED STATES PATENT AND TRADEMARK OFFICE

CERTIFICATE OF CORRECTION

PATENT NO. : 6,539,744 B1
DATED : April 1, 2003
INVENTOR(S) : Chun-cheng Piao et al.

It is certified that error appears in the above-identified patent and that said Letters Patent is hereby corrected as shown below:

Column 15,
Line 65, change “exhaust air whereby” to -- exhaust air, whereby --

Signed and Sealed this

Twenty-fourth Day of February, 2004

JON W. DUDAS
*Acting Director of the United States Patent and Trademark Office*